United States Patent [19]

Snyder et al.

[11] Patent Number: 4,938,530

[45] Date of Patent: Jul. 3, 1990

[54] WIRE FRAME CHAIR

[75] Inventors: Carlon D. Snyder, Alto; Robert M. Scheper, Grand Rapids, both of Mich.

[73] Assignee: Steelcase, Inc., Grand Rapids, Mich.

[21] Appl. No.: 234,614

[22] Filed: Aug. 22, 1988

Related U.S. Application Data

[63] Continuation-in-part of Ser. No. 150,100, Jan. 27, 1988.

[51] Int. Cl.[5] ..... A47C 3/00

[52] U.S. Cl. ..... 297/287; 297/457; 297/288

[58] Field of Search ..... 297/287, 288, 286, 419, 297/290, 294, 295, 457

[56] References Cited

U.S. PATENT DOCUMENTS

| | | | |
|---|---|---|---|
| D. 98,137 | 1/1936 | Bevelacqua . | |
| D. 112,869 | 1/1939 | Vavrik . | |
| D. 131,080 | 1/1942 | Anderson . | |
| D. 235,711 | 7/1975 | Acton | D6/69 |
| D. 243,425 | 2/1977 | Gibson | D6/75 |
| D. 285,875 | 9/1986 | Goldman | D6/376 |
| 2,046,715 | 7/1936 | Zerbee | 297/457 X |
| 2,080,607 | 5/1937 | Galante | 297/287 |
| 2,135,833 | 11/1938 | Oermann . | |
| 3,061,374 | 10/1962 | Grosfillex | 297/457 X |
| 3,351,378 | 11/1967 | Bliss | 297/239 |
| 3,446,530 | 5/1969 | Rowland | 297/239 |
| 3,594,038 | 7/1971 | Polsky et al. | 297/457 |
| 3,734,561 | 5/1973 | Barecki et al. | 297/457 |
| 3,999,802 | 12/1976 | Powers | 297/447 |
| 4,290,645 | 9/1981 | Glickman et al. | 297/239 |
| 4,522,444 | 6/1985 | Pollock | 297/239 |
| 4,618,185 | 10/1986 | Kaufman | 297/285 |
| 4,648,653 | 3/1987 | Rowland | 297/239 |

FOREIGN PATENT DOCUMENTS

| | | | |
|---|---|---|---|
| 764919 | 3/1934 | France | 297/288 |

OTHER PUBLICATIONS

Castelli: Penelope.

*Primary Examiner*—Peter A. Aschenbrenner
*Attorney, Agent, or Firm*—Price, Heneveld, Cooper, DeWitt & Litton

[57] ABSTRACT

A chair particularly suited for institutional multipurpose rooms, and the like, includes a base and a shell with a back and a seat which are constructed for generally contemporaneous movement. A first support connects the base with a medial portion of the seat to support the same in a cantilevered fashion, and is resiliently flexible to permit the shell to rock in response to fore-to-aft movement of a seated user. A second support connects the base with the back, and is also resiliently flexible to permit and control the rocking motion of the shell in a manner that provides improved comfort, and reduces sitting fatigue. Preferably, the support also permits the shell to move in a controlled manner from side to side in response to lateral movement of a seated user.

30 Claims, 4 Drawing Sheets

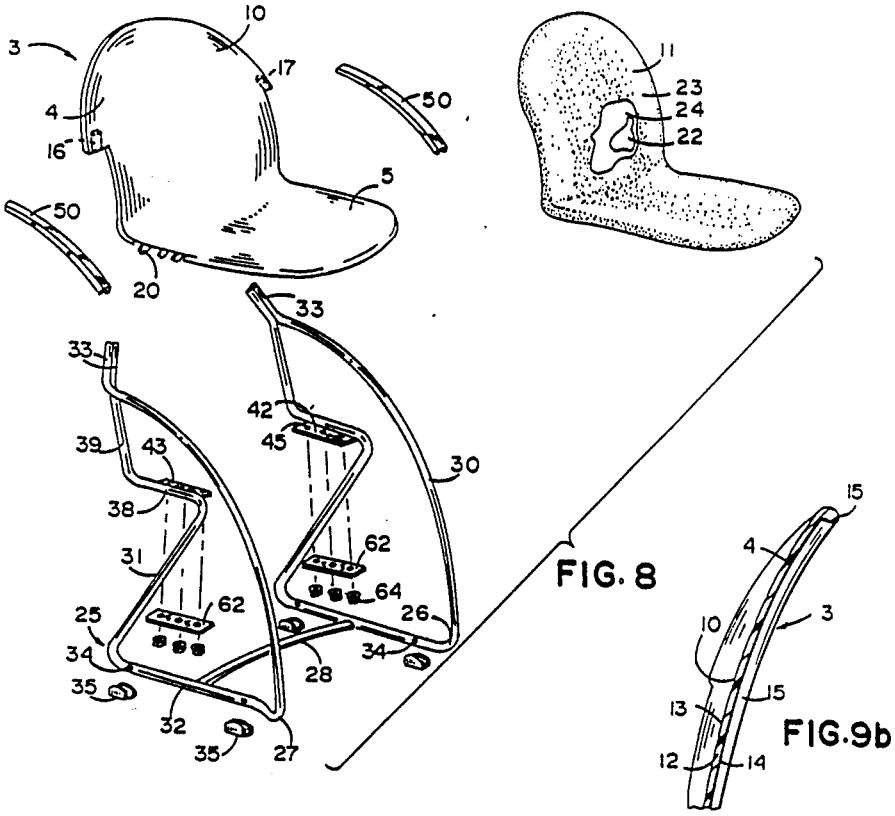
FIG. 8
FIG. 9b
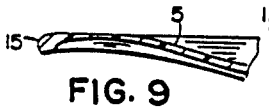
FIG. 9
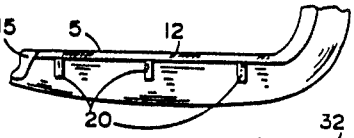
FIG. 9a
FIG. 10
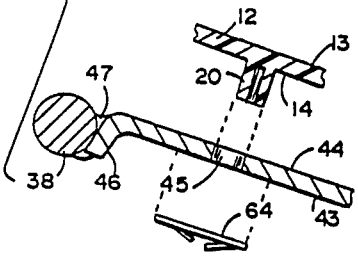
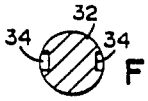
FIG. 12
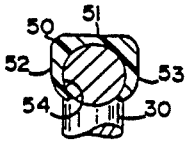
FIG. 11
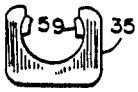
FIG. 13

WIRE FRAME CHAIR

CROSS-REFERENCE TO RELATED APPLICATIONS

The present application is a continuation-in-part of co-pending U.S. patent application Ser. No. 150,100, filed Jan. 27, 1988 on CHAIR DESIGN ("470 STACKER"—Informal Photo Case) which is hereby incorporated by reference.

BACKGROUND OF THE INVENTION

The present invention relates to seating, and in particular to institutional seats particularly suited for multipurpose rooms, and the like.

Chairs for seating in institutional settings, particularly relatively large open areas, such as auditoriums, ballrooms, gymnasiums, convention centers, and the like are well known in the art. Such chairs preferably stack or nest within one another for storage, such that large multipurpose floor spaces can be rapidly converted into seating areas and back again into open areas for recreation. Stacking chairs are typically provided with some type of ganging mechanism, such that the chairs can be set and temporarily retained in predetermined rows, or other selected configurations.

Because of their specialized purpose, stacking chairs must necessarily be relatively lightweight, durable, and have a simple, space efficient design that can be manufactured relatively inexpensively. Furthermore, stacking chairs must also have a relatively thin profile, so that a substantial number of chairs can be stored in a single stack. This thin profile limits the amount of upholstery which can be applied to the seat and back of the chair.

As a result of these specialized requirements, stacking chairs have heretofore been rather uncomfortable to sit in, largely due to their normally rigid construction, and limited padding and/or upholstery.

SUMMARY OF THE INVENTION

One aspect of the present invention is to provide a more comfortable chair for institutional uses, such as multipurpose rooms, and the like. The chair includes a base and a shell with a back and a seat constructed for generally contemporaneous movement. A first support connects the base with the medial portion of the seat to support the same in a cantilevered fashion, and is resiliently flexible to permit the shell to rock in response to fore-to-aft movement of the seated user. A second support connects the base with the back, and is also resiliently flexible to permit and control the rocking motion of the shell in a manner that provides improved comfort, and reduces sitting fatigue.

In another aspect of the present invention the supports also permit the shell to swing or move in a controlled manner generally horizontally from side to side in response to lateral movement of the seated user to provide even greater comfort.

The principal objects of the present invention are to provide an institutional type of chair, which has a lightweight, space efficient, durable design, and also provides improved comfort, with reduced sitting fatigue. A unique resilient wire frame arrangement permits the user to rock in the chair in a controlled manner. The chair has a relatively thin profile to achieve efficient stacking, and is extremely durable. The chair is economical to manufacture, capable of a long operating life, and particularly well adapted for the proposed use.

These and other features, advantages and objects of the present invention will be further understood and appreciated by those skilled in the art by reference to the following written specification, claims, and appended drawings.

BRIEF DESCRIPTION OF THE DRAWINGS

FIG. 8 is an exploded, perspective view of the chair.

FIG. 9 is a fragmentary, vertical cross-sectional view of a shell portion of the chair, showing a forward portion of a seat and being taken along a center portion thereof.

FIG. 9A is a fragmentary, side elevational view of the shell, showing a rear upper portion of the seat.

FIG. 9B is a fragmentary, vertical cross-sectional view of the shell, showing an upper portion of a back, and being taken along a center portion thereof.

FIG. 10 is a fragmentary, vertical cross section of the chair, particularly showing the attachment of the shell to a frame portion of the chair.

FIG. 11 is a fragmentary, transverse cross-sectional view of the chair, particularly showing an arm cap portion thereof.

FIG. 12 is a vertical, transverse cross-sectional view of the chair, particularly showing the base portion of the frame.

FIG. 13 is an end elevational view of a glide portion of the chair.

DETAILED DESCRIPTION OF THE PREFERRED EMBODIMENTS

Figure 1:
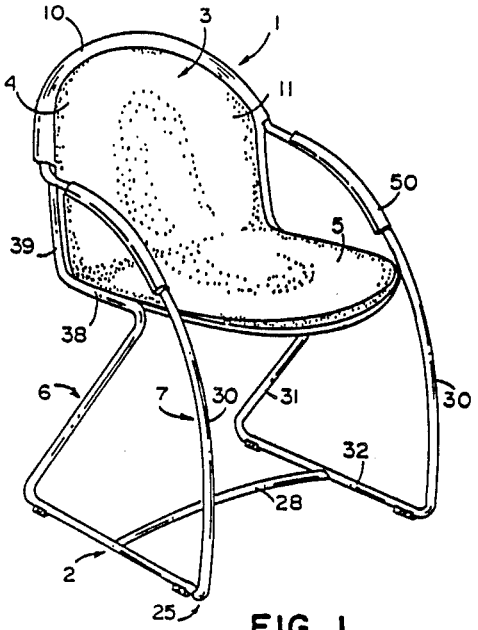
FIG. 1 is a perspective view of a chair embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a chair embodying the present invention, which is particularly suited for institutional, multipurpose rooms and the like. Chair 1 includes a base 2, and a shell 3 with a back portion 4 and a seat portion 5 constructed for generally contemporaneous movement. A first support 6 connects base 2 with a medial portion of seat 5 to support the same in a cantilevered fashion, and is resiliently flexible to permit shell 3 to rock (FIGS. 2–4) in response to fore-to-aft movement of a seated user. A second support 7 connects base 2 with back 4, and is also resiliently flexible to permit and control the rocking motion (FIGS. 2–4) of shell 3 in a manner that provides improved comfort. Preferably, supports 6 and 7 also permit shell 3 to move in a controlled manner generally horizontally from side to side (FIGS. 5–7) in response to lateral movement of the seated user for even greater comfort, with reduced sitting fatigue.

In the illustrated embodiment of the present invention, shell 3 (FIG. 8) comprises a one-piece, integrally molded outer shell 10, and an upholstered inner shell assembly 11, both of which have a generally L-shaped side elevational configuration. As best illustrated in FIGS. 9–9B, outer shell 10 comprises a relatively thin plastic sheet 12, having a front surface 13, and rear surface 14. A rib 15 is molded integrally about the marginal edge of sheet 12, and extends generally rearwardly and downwardly therefrom. Rib 15 both rigidifies and strengthens outer shell 10. Preferably, outer shell 10 is relatively stiff or semi-rigid, with some degree of resilient flexibility to provide improved comfort. The seat portion of outer shell 10 may be selectively rigidified by one or more integrally formed ribs (not shown) formed on the lower surface of outer shell 10, and extending in a fore-to-aft direction. In one embodiment of the present invention, shell 3 is molded from a glass fiber reinforced thermoplastic material, such as polyetheylene, nylon, or the like with sheet 12 having a thickness of around 0.115–0.135 inch, and rib 15 with a width of around ⅜ inch, and a depth of approximately ½ inch. However, it is to be understood that outer shell 10 may be constructed from other materials, including formed wood, expanded metal, stamped metal sheets, wire mesh, and other similar materials.

Figure 14:
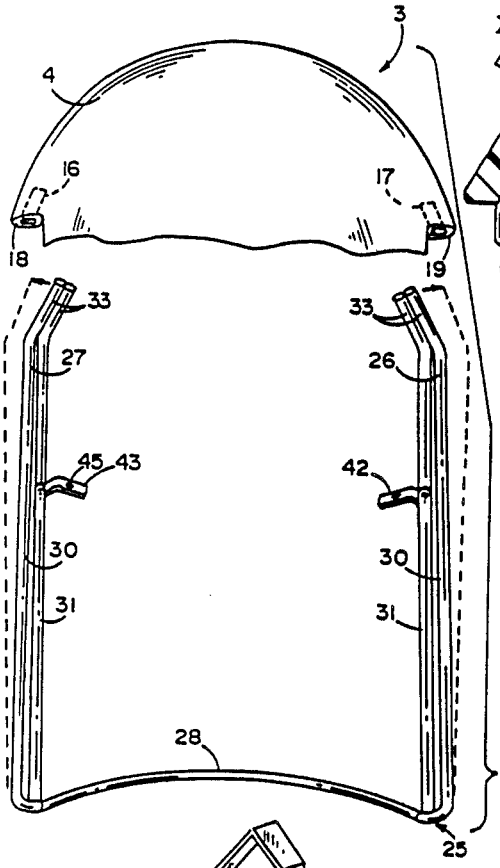
FIG. 14 is an exploded, fragmentary rear elevational view of the chair, illustrating the assembly of the shell onto the frame.
Figure 15:
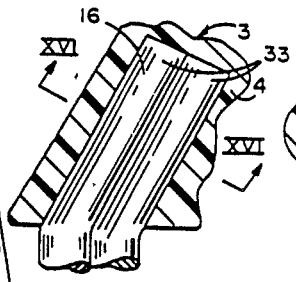
FIG. 15 is a vertical cross-sectional view of the chair, particularly showing the mounting of the back portion of the shell onto the frame.
Figure 16:
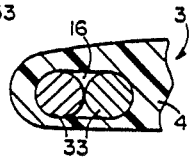
FIG. 16 is a cross-sectional view of the chair, taken along the line XVI—XVI of FIG. 15.

As best illustrated in FIGS. 14–16, the back portion 4 of shell 3 includes a pair of pockets 16 and 17 disposed at the opposite sides of back 4 adjacent the upper portion thereof. Pockets 16 and 17 are preferably molded integrally in place, and open downwardly to associated ledges 18 and 19 respectively. With reference to FIGS. 14 and 15, pockets 16 and 17 are slightly tapered, are inclined inwardly at their upper ends, and are specially shaped to mate with associated portions of frame members 6 and 7, as described in detail below.

A plurality of fastening bosses 20 (FIGS. 9–9B and 10) are integrally molded on the lower surface of seat 5, and extend downwardly therefrom on opposite sides of seat 5 to facilitate attaching shell 3 to the frame members 6 and 7. In the illustrated example, both sides of seat 5 include three, hollow bosses 20, which are spaced laterally inwardly from the adjacent rib 13 at the side of seat 5, and are aligned in a fore-to-aft direction toward the rearward portion of seat 5. The illustrated bosses 20 have a generally cylindrical shape, and extend substantially perpendicular from the lower surface 14 of seat 5.

The upholstered inner shell assembly 11 includes a relatively thin, plastic inner sheet 22 over which a layer of fabric 23 is stretched and attached by conventional means, such as adhesives, stapling or the like. The outer edges of fabric layer 23 are pulled over the marginal edge of inner sheet 22, and attached to the rear surface thereof by stapling or the like, to provide a neat, finished appearance. A thin sheet 24 of padding, cushioning, foam or the like may be sandwiched between inner sheet 22 and fabric layer 23 to provide improved comfort.

Inner shell assembly 11 is attached to the upper surface 13 of shell 3 in a conventional manner, such as fasteners, adhesives, or the like. It is to be understood that chair 1 may be constructed either with or without inner shell assembly 11, as desired by the user. Inner shell assembly 11 may either have a conventional upholstered construction, or a molded construction to minimize thickness. Inner shell assembly 11 may be detachably mounted on outer shell 10 to facilitate the repair of inner shell assembly 11, or replacement of the same for decorative purposes.

In the illustrated embodiment of the present invention, supports 6 and 7 comprise a wire frame 25 (FIG. 1), which resiliently supports shell 3 in a manner that permits both fore-to-aft and lateral rocking action. As shown in FIG. 8, the illustrated wire frame 25 includes two side support wires 26 and 27, and a cross brace 28 interconnecting side support wires 26 and 27 in a normally vertically extending orientation. Side support wires 26 and 27 are positioned along the left- and right-hand sides of shell 3, and are substantially identical in construction, except that they are oppositely handed. For ease of the detailed description of support wires 26 and 27, reference will be had only to the right-hand side support wire 27.

As illustrated in FIGS. 1–4, side support wire 27 comprises a one-piece, loop-shaped bent bar or rod, having a front leg portion 30, a rear leg portion 31, and a base portion 32. Side support wire 27 has its free ends 33 (FIG. 8) positioned side-by-side at the uppermost portion of the side support wire, with free ends 33 being fixedly interconnected, by means such as welding, or the like. The base 32 (FIGS. 1–4) of frame 25 has a generally linear shape, (FIGS. 8 and 12) and includes two pairs of laterally extending dimples 34 at the forward and rearward portions of base 32 to facilitate attaching glides 35 in the manner described in greater detail hereinafter. Dimples 34 are formed by punching, stamping or otherwise deforming the base 32, as opposed to drilling, or the like, to alleviate forming stress risers in frame 25.

Figure 4:
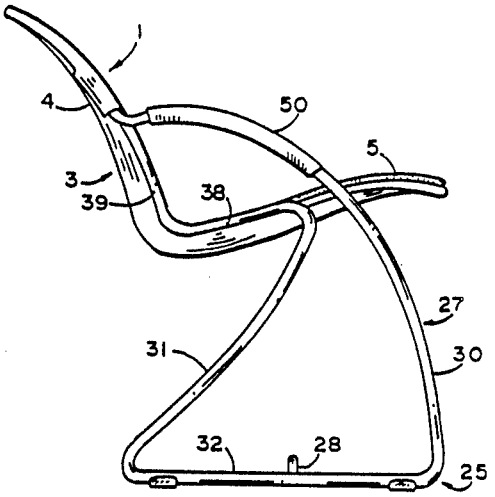
FIG. 4 is a side elevational view of the chair, shown in an occupied rearwardly tipped position.
Figure 5:
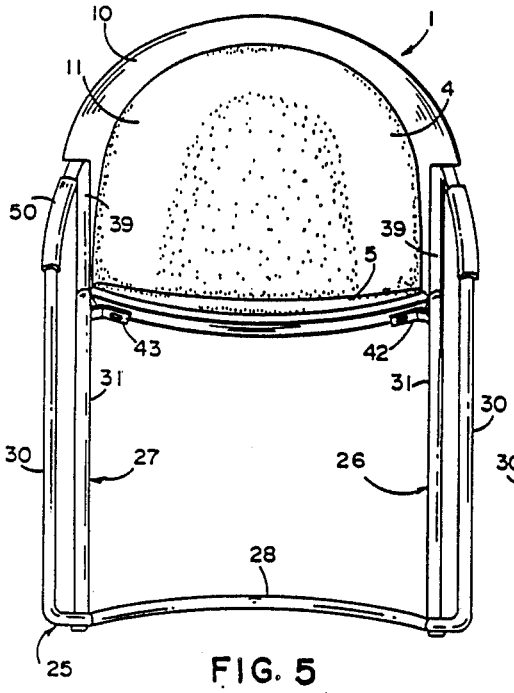
FIG. 5 is a front elevational view of the chair, shown in an unoccupied, neutral position.
Figure 6:
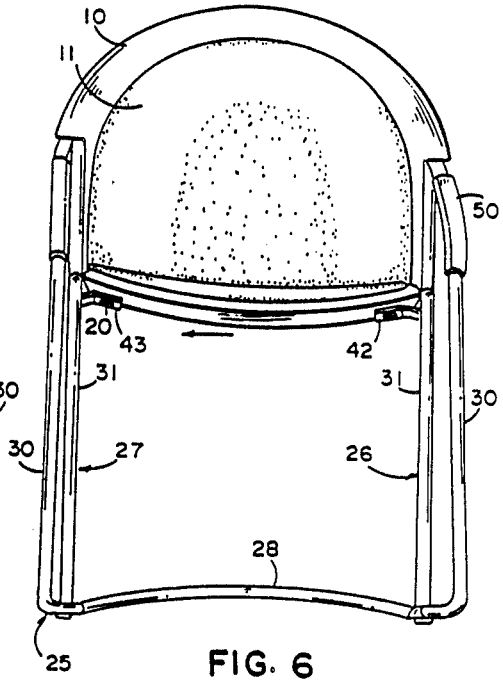
FIG. 6 is a front elevational view of the chair, shown in an occupied condition, laterally shifted to the right as viewed by a seated user.
Figure 7:
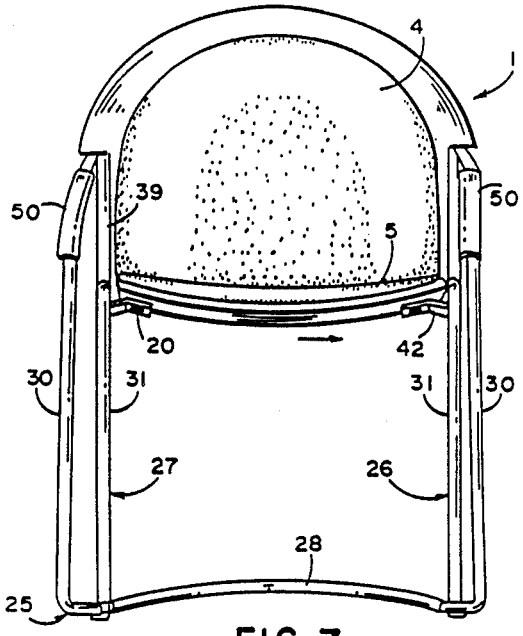
FIG. 7 is a front elevational view of the chair, shown in an occupied condition, laterally shifted to the left as viewed by a seated user.

Cross brace 28 is fixedly attached to the medial portions of the opposite bases 32 on the left- and right-hand side support wires 26 and 27, and has an upwardly extending arcuate configuration, as illustrated in FIGS. 5–7. Front leg 30 has an arcuate side elevational configuration (FIGS. 2–4) which bows outwardly toward the front portion of seat 5. Rear leg 31, in combination with base 32, has a generally Z-shaped side elevational configuration. Rear leg 31 is inclined forwardly from base 32, and has at its upper portion, a horizontal leg 38 and a vertical leg 39 disposed in an L-shaped relationship. As best shown in FIGS. 1 and 5–7, the loWer ends of front legs 30 are flared laterally outwardly as they blend into the forward portions of bases 32. As a result, front legs 30 are spaced laterally outwardly from the rear legs 31, which configuration assists in stacking, and the side-to-side seat movement shown in FIGS. 6 and 7.

Each side support wire 26 and 27 is preferably continuously bent from a single length of stock. In the illustrated example, side support wires 26 and 27 have a circular transverse cross-sectional configuration, in the nature of a rod or wire. However, it is to be understood that other bar and/or wire shapes are also contemplated by the present invention, including hollow tubes. Preferably, cross brace 28 is also constructed from a stock material identical to that from which the side support wires 26 and 27 are constructed, so that wire rod frame 25 has a uniform overall appearance. In one working embodiment of the present invention, all portions of wire rod frame 25 are constructed from solid, circular rod stock of 1035 steel, having an outside diameter of approximately one-half inch. The combination of the type of material from which wire rod frame 26 is constructed, as well as its geometry, will determine, at least in part, the degree and manner in which shell 3 will rock or move on frame 25.

With reference to FIGS. 8 and 10, a pair of support brackets 42 and 43 are mounted on the horizontal legs 38 of side support wires 25 and 26, and facilitate attaching shell 3 to wire rod frame 25. Support brackets 42 and 43 are substantially identical in configuration, and each comprises a flat plate 44, having a plurality of apertures 45 disposed transversely through a medial portion of plate 44. Apertures 45 are aligned longitudinally along plate 44, and are spaced apart and mate with the bosses 20 depending from the seat 5 of shell 3. The outer edge of each plate 45 is turned downwardly to form a lip 46 which abuts the adjacent edge of wire leg 38, and is fixedly attached thereto by suitable fasteners, such as the illustrated weld 47. Support brackets 42 and 43 are generally centered in a fore-to-aft direction on the horizontal leg 38 of the respective side support wires 26 and 27, and are angled vertically downwardly somewhat to mate with the configuration of seat 5.

As best illustrated in FIGS. 8 and 11, U-shaped arm caps 50 are provided to cover the upper portions of front legs 30. In the illustrated example, arm caps 50 have a generally flat upper surface 51, curved side surfaces 52 and 53, and a cylindrical inner groove 54 which mates with the shape of side support wires 26 and 27, to provide a snap fit. Arm caps 50 may be injection molded from a synthetic resin material, and may also be fixedly attached to the respective side support wires 26 and 27 by means such as a thermoplastic adhesive, or the like.

Front legs 30 function both as supports for shell 3, and as low profile arms, which are formed integral with wire frame 25. The arcuate, low profile shape of these members permits the user to pull chair 1 up close to a table or other work surface with minimum interference or obstruction. Since the space disposed directly below seat 5 is also free from front cross bracing, and the like, with the exception of member 28, chair 1 does not hinder or obstruct the movement of the user as he shifts to relieve sitting fatigue.

Self leveling glides 58 (FIGS. 8 and 13) are provided for attachment to the base portions 32 of wire rod frame 25. In the illustrated example, glides 35 include inwardly extending tabs 59 which are closely received in the associated dimples 34 of chair base 32 with a snap fit. Hence, glides 58 are securely attached to wire rod frame 25 without causing any unnecessary stress risers, or otherwise damaging the structural integrity of wire frame 25.

Wire frame 25 and shell 3 are configured in a manner that provides a unique assembly for chair 1. With reference to FIG. 14, in the free, unassembled condition, the left- and right-hand side support wires 26 and 27 of wire rod frame 25 taper inwardly toward their free or upper ends, as shown by full lines in FIG. 14. Since cross brace 28 is resiliently flexible, the free ends 33 of side support wires 26 and 27 can be diverged, creating a spring-like action. The free ends 33 of side support wires 26 and 27 are tapered inwardly at an angle which matches the inclination of shell pockets 16 and 17.

Shell 3 is assembled onto wire frame 25 by first diverging the free ends 33 of side support wires 26 and 27 to the extent necessary to insert the free ends 33 of side support wires 26 and 27 into the pockets 16 and 17 of shell 3. Shell 3 is then pushed firmly downwardly onto wire frame 25, until the free ends 33 of side support wires 26 and 27 are closely and fully received within their mating pockets 16 and 17, as shown in FIGS. 15 and 16. The resilient spring force developed in cross base 28 biases the free ends 33 of side support wires 26 and 27 toward one another, thereby resiliently locking wire rod frame 25 and shell 3 together.

Figure 17:
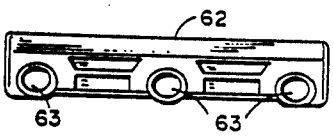
FIG. 17 is a bottom plan view of a bumper portion of the chair.

As the back 4 of shell 3 is inserted onto the free ends 33 of side support wires 26 in the manner described above, the downwardly extending bosses 20 on the seat 5 of shell 3 are contemporaneously inserted through the mating apertures 45 in support brackets 42 and 43. A pair of resilient bumpers 62 (FIGS. 8 and 17) are positioned overlying the lower surfaces of support brackets 42 and 43, with bosses 20 extending through aligned apertures 63 in bumpers 62. The illustrated bumpers 62 are constructed from a plastic material such as a polycarbonate resin, or the like, including resins marketed under the trademark "LEXAN," and serve to form pads for stacking, and also to alleviate any squeaking noises that might be caused by motion between shell 3 and wire rod frame 25. Fasteners, such as the illustrated spring clip retainers 64 (FIG. 8) are then inserted over the free ends of bosses 20, and are pushed securely toward seat 5 to fixedly mount shell 3 on wire frame 25. Once spring clip retainers 64 are in place, the free ends 33 of side support wires 26 and 27 are captured in their mating pockets 16 and 17, and cannot be removed therefrom, thereby positively interlocking shell 3 and wire frame 25. A thermoplastic resin, or other similar material can be inserted into pockets 16 and 17 to fill the same to prevent movement between frame ends 33 and shell 3, as well as any related noise. Shell 3 is thereby securely mounted on wire frame 25 with a minimum number of fasteners to facilitate both manufacture and replacement.

Figure 2:
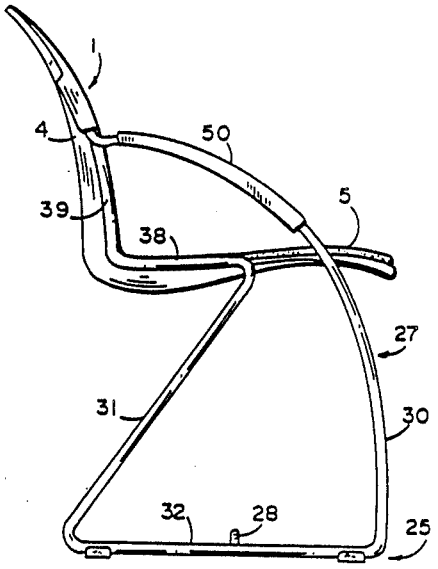
FIG. 2 is a side elevational view of the chair, shown in an unoccupied, neutral position.
Figure 3:
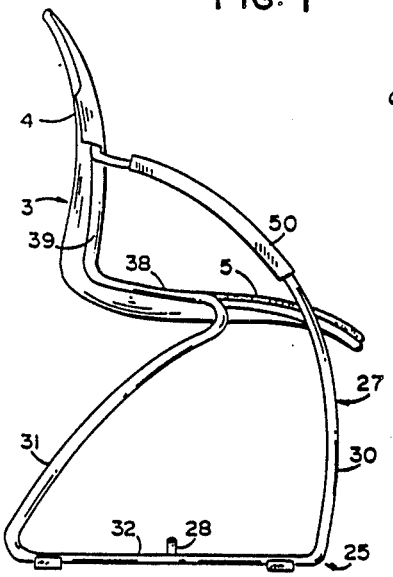
FIG. 3 is a side elevational view of the chair, shown in an occupied, forwardly tipped position.

As best illustrated in FIGS. 1–4, the unique configuration of shell 3 and wire frame 25 combine to provide a unique, comfortable sitting feel to chair 1. Since shell 3 is attached to wire frame 25 at only four locations (i.e. pockets 16 and 17 and brackets 42 and 43), side support wires 26 and 27 can flex relatively unencumbered to relieve sitting fatigue. The resilient flexibility of wire frame 25 permits the user to rock shell 3 forwardly and rearwardly by simply applying force to shell 3 in a fore-to-aft direction by shifting the user's weight, or pushing upwardly with the user's feet. For example, in the position illustrated in FIG. 3, shell 3 is tipped forwardly by applying greater force to the forward portion of seat 5. In contrast, FIG. 4 illustrates the chair in a rearwardly tipped position, which may be achieved by applying additional force to the back 4 of chair 1. The fore-to-aft rocking motion achieved in this fashion is not a free type of spring support, but rather is carefully controlled by the geometry of shell 3 and wire rod frame 25. When shell 3 is tipped forwardly, as shown in FIG. 3, the front legs 30 bow outwardly from their neutral position (FIG. 2) toward the front of seat 5. Contemporaneously, the rear legs 31 bow outwardly from their neutral position (FIG. 2) toward the rear of seat 5, and the angle between each horizontal leg 38 and its associated rear leg 31 increases. The bowing action of front legs 30 and rear legs 31 controls the rocking action of the chair to prevent experiencing an overly springy or uncontrolled type of rocking action.

In a like manner, when shell 3 is tilted rearwardly, front legs 30 are flattened slightly rearwardly from their normally bowed shape (FIG. 2). Contemporaneously, rear legs 31 bow inwardly from their neutral position (FIG. 2) toward the front of seat 5, and the angle between each vertical leg 38 and its associated rear leg 31 is decreased. The unique rocking action achieved by the combination of shell 3 and wire frame 25 permits the user to shift his weight in seat 5 so as to alleviate pressure concentrations in any particular part of the user's body for an extended period of time.

Chair 1 also has a unique lateral movement which is best illustrated in FIGS. 5–7. The cantilevered support provided by the rear legs 31 of wire frame 25 permits seat 5 to move generally horizontally from left to right between front legs 30. The presprung condition of side support wires 26, along with their overall geometry, assist in returning seat 5 to its normally centered, neutral position, as shown in FIG. 5. By shifting the user's weight from one side to the other, or otherwise applying transverse force to shell 3, the user can readily move seat 5 laterally to relieve pressure concentrations over an extended period of time. The interaction of legs 30 and bases 32 provides a leaf spring type of action which resiliently returns seat 5 to the normally centered position between side support wires 26.

As an example of the unique rocking motion achieved by chair 1, in one working embodiment of the present invention, back 4 will move or tilt rearwardly from the neutral position shown in FIG. 2 an angular measure in the range of 1–10 degrees. In this same working embodiment, seat 5 will move or tip downwardly from the neutral position shown in FIG. 2 an angular measure in the range of 1–5 degrees, and total side-to-side travel, as shown in FIGS. 6 and 7, is in the range of approximately 1/16–½ inch.

Figure 20:
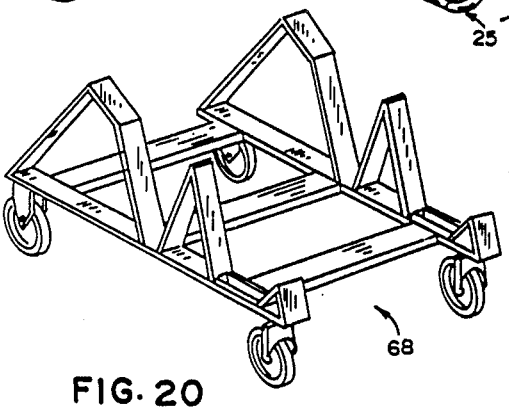
FIG. 20 is a perspective view of the dolly.
Figure 19:
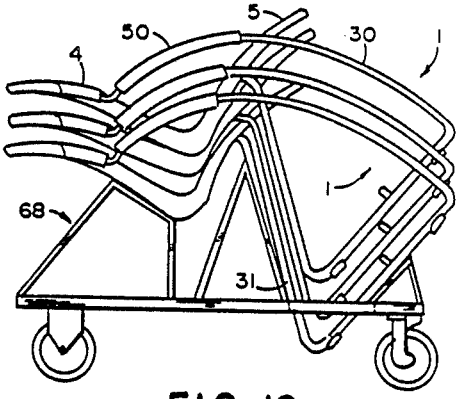
FIG. 19 is a side elevational view of a plurality of chairs stacked on a dolly.

With reference to FIGS. 19 and 20, a dolly 68 may be provided to support a plurality of chairs 1 in a stacked condition, and facilitate transporting the same between various locations. The chairs 1 nest together by abutment between adjacent bosses 20 and rear legs 31 in the manner illustrated in FIG. 19.

Figure 18:
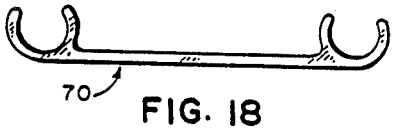
FIG. 18 is an end elevational view of a ganging clamp to interconnect adjacent chairs.

When set in rows, or other predetermined configurations, adjacent chairs 1 can be interconnected by a ganging clamp 70 (FIG. 18), which snaps over the lower surfaces of adjacent base members 32.

The fore-to-aft rocking action of chair 1, particularly in combination with the side-to-side movement described above, provides a unique floating type of support for shell 3 that achieves greater comfort for the user, and reduces sitting fatigue. At the same time, chair 1 has a space efficient design, is lightweight, and provides a thin profile for stacking.

In the foregoing description, it will be readily appreciated by those skilled in the art that modifications may be made to the invention, without departing from the concepts disclosed herein. Such modifications are to be considered as included in the following claims, unless these claims by their language expressly state otherwise.

The embodiments of the invention in which an exclusive property or privilege is claimed are defined as follows:

1. A chair comprising:

a shell shaped to support a seated user thereon, including a back and a seat interconnected for generally contemporaneous movement;

a base adapted to support said shell on a surface, and including forward and rearward portions;

a first support having a lower portion thereof connected with the rearward portion of said base, and an upper portion thereof connected with a medial portion of said seat to support the same in a cantilevered fashion on said base; said first support having at least a portion thereof resiliently flexible to permit said shell to rock with respect to said base in response to fore-to-aft movement of a seated user;

a second support having a lower portion thereof connected with the forward portion of said base, and an upper portion thereof connected with said back; said second support having at least a portion thereof resiliently flexible to permit and control the rocking motion of said shell in a manner that provides improved comfort.

2. A chair as set forth in claim 1, wherein:

said first and second supports include means for permitting said shell to move generally horizontally from side to side with respect to said base in response to lateral movement of a seated user.

3. A chair as set forth in claim 2, wherein: said shell has a one-piece, integrally formed construction.

4. A chair as set forth in claim 3, wherein:

said base, said first support and said second support are collectively defined by a wire rod frame, comprising first and second side support wires, and a cross-brace interconnecting said side support wires in a normally vertically extending orientation.

5. A chair as set forth in claim 4, wherein:

said side support wires each comprises a one-piece, loop-shaped, bent rod having a front leg portion, a rear leg portion, a base portion, and interconnected free ends.

6. A chair as set forth in claim 5, wherein:

said rear leg and base portions of said side support wires have a generally Z-shaped side elevational configuration.

7. A chair as set forth in claim 6, wherein:

said seat includes opposite side edges, which extend between front and rear portions of said seat; and said rear leg portion of each of said side support wires includes a horizontal leg which is fixedly attached to said seat, and extends along the associated side edge thereof from the medial portion of said seat to a location adjacent to the rear portion of said seat, whereby the front portion of said seat is free and supported over said base in a cantilevered fashion.

8. A chair as set forth in claim 7, wherein:

said front leg portion of each of said side support wires has an arcuate side elevational configuration which bows outwardly toward the front portion of said seat.

9. A chair as set forth in claim 8, wherein:

said front leg portion of each of said side support wires includes an upper end connected with said back adjacent a medial portion of said back.

10. A chair as set forth in claim 9, wherein:

said rear leg portion of each of said side support wires includes an upstanding leg with an upper end connected with said back adjacent the medial portion of said back.

11. A chair as set forth in claim 10, wherein:

said upper ends of said rear and front leg portions define the free ends of said side support wires, and are fixedly interconnected in a side-by-side relationship.

12. A chair as set forth in claim 11, wherein:

said back includes first and second pockets positioned along opposite side edges thereof shaped to closely receive and retain therein the free ends of said side support wires.

13. A chair as set forth in claim 12, wherein:

said side support wires are oriented in a laterally tapered relationship with the free ends thereof assuming a converged relationship prior to assembly with said back; and said cross-brace has at least a portion thereof resiliently flexible to permit the free ends of said side support wires to be diverged from said converged relationship for insertion into said pockets, and being configured such that the spring force so generated in said cross brace resiliently retains the free ends of said side support wires in said pockets.

14. A chair as set forth in claim 13, wherein:

said seat includes at least two depending fasteners disposed adjacent the opposite side edges thereof, which are vertically received and retained in mating apertures associated with the horizontal leg of each of said side support wires; and said seat pockets and said fasteners being arranged such that said fasteners positively prevent said shell from being separated from said wire rod frame an amount which would permit the free ends of said side support wires to be withdrawn from said pockets.

15. A chair as set forth in claim 14, wherein:

said shell is resiliently flexible to provide improved comfort.

16. A chair as set forth in claim 1, wherein:

said shell has a one-piece, integrally formed construction.

17. A chair as set forth in claim 1, wherein:

said base, said first support and said second support are collectively defined by a wire rod frame, comprising first and second side support wires, and a cross-brace interconnecting the same in a normally vertically extending orientation.

18. A chair as set forth in claim 17, wherein:

said side support wires each comprises a one-piece, loop-shaped, bent rod having a front leg portion, a rear leg portion, a base portion, and interconnected free ends.

19. A chair as set forth in claim 18, wherein:

said rear leg and base portions of said side support wires have a generally Z-shaped side elevational configuration.

20. A chair as set forth in claim 19, wherein:

said seat includes opposite side edges, which extend between front and rear portions of said seat; and said rear leg portion of each of said side support wires includes a horizontal leg which is fixedly attached to said seat, and extends along the associated side edge thereof from the medial portion of said seat to a location adjacent to the rear portion of said seat, whereby the front portion of said seat is free and supported over said base in a cantilevered fashion.

21. A chair as set forth in claim 20, wherein:

said front leg portion of each of said side support wires has an arcuate side elevational configuration which bows outwardly toward the front portion of said seat.

22. A chair as set forth in claim 21, wherein:

said front leg portion of each of said side support wires includes an upper end connected with said back adjacent a medial portion of said back.

23. A chair as set forth in claim 22, wherein:

said rear leg portion of each of said side support wires includes an upstanding leg with an upper end connected with said back adjacent the medial portion of said back.

24. A chair as set forth in claim 23, wherein:

said upper ends of said rear and front leg portions define the free ends of said side support wires, and are fixedly interconnected in a side-by-side relationship.

25. A chair as set forth in claim 24, wherein:

said back includes first and second pockets positioned along opposite side edges thereof shaped to closely receive and retain therein the free ends of said side support wires.

26. A chair as set forth in claim 25, wherein:

said side support wires are oriented in a laterally tapered relationship with the free ends thereof assuming a converged relationship prior to assembly with said back; and said cross-brace has at least a portion thereof resiliently flexible to permit the free ends of said side support wires to be diverged from said converged relationship for insertion into said pockets, and being configured such that the spring force so generated in said cross brace resiliently retains the free ends of said side support wires in said pockets.

27. A chair as set forth in claim 26, wherein:

said seat includes at least two depending fasteners disposed adjacent the opposite side edges thereof, which are vertically received and retained in mating apertures associated with the horizontal leg of each of said side support wires; and said seat pockets and said fasteners being arranged such that said fasteners positively prevent said shell from being separated from said wire rod frame an amount which would permit the free ends of said side support wires to be withdrawn from said pockets.

28. A chair as set forth in claim 1, wherein:

said shell is resiliently flexible to provide improved comfort.

29. A chair comprising:

a shell shaped to support a seated user thereon, including a back and a seat interconnected for generally contemporaneous movement;

a wire rod frame selectively supporting said shell above a floor surface, and comprising a pair of side support wires, each having a one-piece, loop-shaped bent rod with a base shaped to abut the floor surface, an integral rear leg having an upper end thereof connected with a medial portion of the seat to support the same in a cantilevered fashion, and an integral front leg having an upper end thereof connected with a medial portion of the back, such that fore-to-aft movement of a seated user causes said shell to rock in a fore-to-aft direction on said frame in a controlled manner that provides improved comfort.

30. A chair comprising:

a shell shaped to support a seated user thereon, including a back and a seat interconnected for generally contemporaneous movement;

a base adapted to support said shell on a surface;

a first support having a lower portion thereof connected with said base, and an upper portion thereof connected with a medial portion of said seat to support the same in a cantilevered fashion on said base; said first support having at least a portion thereof resiliently flexible to permit said shell to rock with respect to said base in response to fore-to-aft movement of a seated user;

a second support having a lower portion thereof connected with said base, and an upper portion thereof connected with said back; said second support having at least a portion thereof resiliently flexible to permit and control the rocking motion of said shell in a manner that provides improved comfort; and wherein said base, said first support and said second support are collectively defined by a wire rod frame, comprising first and second side support wires, and a cross-brace interconnecting the same in a normally vertically extending orientation; and wherein;

said base, said first support and said second support are collectively defined by a wire rod frame, comprising first and second side support wires, and a cross-brace interconnecting the same in a normally vertically extending orientation;

said side support wires each comprise a one-piece, loop-shaped, bent rod having a front leg portion, a rear leg portion, a base portion, and interconnected free ends;

said rear leg and base portions of said side support wires have a generally Z-shaped side elevational configuration;

said seat includes opposite side edges, which extend between front and rear portion of said seat; and said rear leg portion of each of said side support wires includes a horizontal leg which is fixedly attached to said seat, and extends along the associated side edge thereof from the medial portion of said seat to a location adjacent to the rear portion of said seat, whereby the front portion of said seat is free and supported over said base in a cantilevered fashion.

* * * * *